United States Patent [19]

Kraiss

[11] Patent Number: 4,618,122

[45] Date of Patent: Oct. 21, 1986

[54] CORE SEGMENT FOR CONCRETE FORMING APPARATUS

[75] Inventor: Richard Kraiss, Laichingen-Suppingen, Fed. Rep. of Germany

[73] Assignee: Georg Prinzing GmbH & Co. KG Betonformen-und Maschinenfabrik, Blaubeuren, Fed. Rep. of Germany

[21] Appl. No.: 694,641

[22] Filed: Jan. 24, 1985

[30] Foreign Application Priority Data

Jun. 22, 1984 [DE] Fed. Rep. of Germany ..... 3422980

[51] Int. Cl.[4] ..... B28B 7/30

[52] U.S. Cl. ..... 249/94; 249/10; 249/93; 249/178; 249/184; 249/192; 425/441

[58] Field of Search ..... 249/10, 11, 63, 93, 249/94, 97, 102, 151, 152, 178, 180, 184, 192, 194; 425/438, 441, 443

[56] References Cited

U.S. PATENT DOCUMENTS

| | | | |
|---|---|---|---|
| 889,091 | 5/1908 | Ballinger | 249/63 |
| 1,018,072 | 2/1912 | Neeley | 249/63 |
| 1,535,023 | 4/1925 | Kelley | 249/97 |
| 2,193,798 | 11/1959 | Breguet | 249/94 |
| 2,680,276 | 6/1954 | Filangeri | 249/180 |
| 3,142,882 | 8/1964 | Lovers | 249/94 |
| 3,345,716 | 10/1967 | Uden | 249/151 |
| 3,729,165 | 4/1973 | Trimble | 249/184 |
| 3,957,409 | 5/1976 | Grosch | 249/53 R |

FOREIGN PATENT DOCUMENTS

| | | | |
|---|---|---|---|
| 3110185 | 9/1982 | Fed. Rep. of Germany | 249/94 |
| 8403621 | 4/1984 | Fed. Rep. of Germany . | |

*Primary Examiner*—Jay H. Woo
*Assistant Examiner*—James C. Housel
*Attorney, Agent, or Firm*—Michael J. Striker

[57] ABSTRACT

An interchangeable core segment for mould equipment for concrete parts includes a wall portion comprising the apertures and strengthened on its inside face by reinforcing ribs rigid thereon and extending transversely to the plane of the wall portion and over the entire width thereof. The reinforcing ribs are immediately adjacent the top edge or bottom edge of the associated aperture and are at the same level and have on their respective upper and under sides a plane supporting face for a climbing element which has to be placed thereon in order to be cemented into position. The clamping devices which firmly grip the climbing elements placed on them from above or below are disposed on a common clamping frame which is guided for movement on the wall portion with lateral and rear guide means. For each aperture, the clamping devices have facing plates which are pressed against the back of the wall portion, entirely and tightly sealing the aperture. At the same time, upon relative displacement between clamping frame and wall portion, they constitute an additional support and guidance for the clamping frame. The guide means of the clamping frame are adjustable.

36 Claims, 10 Drawing Figures

CORE SEGMENT FOR CONCRETE FORMING APPARATUS

BACKGROUND OF THE INVENTION

The invention relates to a core segment for forming equipment for the shaping of concrete parts, e.g., shaft rings, shaft necks or the like, which are provided with at least one projecting element, particularly a climbing element, such as a climbing iron, stirrup or the like, which is adapted to be cemented from the inside into the concrete parts which are to be formed.

Core segments of this type, particularly exchangeable core segments, are disclosed, for instance in Germany Utility Model No. 84 03 621. In operation, such core segments are exposed to very heavy loadings, particularly vibratory loadings during the riddling and compaction process. During these processes, the core segment is rigidly clamped by the drive means from the inside outwardly so that it can resist the pressure of the concrete. It has been found that the wall portion of the core segment may well be forced inwardly or may become deformed in some other manner and also has a tendency toward cracks due to vibration under the high stress involved.

SUMMARY OF THE INVENTION

An object of the invention is to provide a core segment which offers a substantially greater level of strength and flexural resistance and which also in the long term is capable of withstanding without damage the considerable vibratory loadings during the riddling and compaction process.

According to the invention there is provided a core segment for moulding equipment for forming concrete parts which are provided with at least one projecting element, particularly a climbing element, such as a climbing iron, stirrup or the like, which, during the forming process, is adapted to be concreted from the inside into the concrete part which is to be formed, the core segment having in a wall portion apertures and also housings for the projecting elements, clamping means associated with the housings and a clamping drive associated with the said clamping means, the improvement being that the wall portion has on its inside face rigid reinforcing ribs which extend inwardly from and transversely to the plane of the wall portion. Consequently, a substantially greater rigidity of the core segment is achieved and it is guaranteed that the core segment will n-t suffer any damage even under the high vibratory loadings, but will stand fast for long working periods. At the same time, the reinforcing means are simple and are provided at a favorable cost.

In a advantageous embodiment the wall portion has a predetermined width, and the reinforcing ribs may extend completely over the width of the wall portion. Since the reinforcing ribs extend over the entire width of the wall portion, they impart considerable strength to it. Constructed as annular strips formed to extend at a right angle from said wall portion the reinforcing ribs may be, for example welded on the back of the wall portion which is easily and inexpensively carried out and which leads to considerable strength.

In a further advantageous embodiment the reinforcing ribs are directly adjacent to the upper or lower edge of the apertures, and have a lower or upper face extending substantially at a right angle to the wall portion forming a flat supporting face for a projecting element.

This makes special otherwise existing housings in the region of the apertures are unnecessary. Instead, this function of forming a housing and a supporting face for the elements to be concreted into position is fulfilled at the same time by the reinforcing ribs. This reduces labor and expense and also the weight of the core segment, which is of course advantageous particularly on account of the exchangeability.

In an additional embodiment, the wall portion has two side edges; rails and guides may be located on both side edges and extend transversely of the reinforcing ribs, the rails and guides being provided for core segment exchange.

In the case of a core segment of this type, with or even without reinforcing ribs, the measures according to a further embodiment are particularly favorable. In this embodiment the clamping means includes associated clamping devices and a common clamping frame located on the wall portion, the housings for the projecting elements and the associated clamping devices are located on the common clamping frame, the clamping means includes guide means for the clamping frame so that upon actuation of the clamping drive the clamping frame is guided for movement between a release position and a closed position in a direction parallel with the wall portion. Such a clamping frame which is disposed on the back of the wall portion, serves additionally to strengthen the wall portion and thus the core segment as a whole. At the same time, the design of the individual clamping devices is simplified.

In a further advantageous embodiment the wall portion has a shape, and the clamping means may include at least one facing plate, one facing plate being provided for each of the apertures, disposed on the inside face of the wall portion and adapted to the shape of the wall portion at least in the region of a respective aperture, each facing plate having a surface area sufficiently large so that in the closed position of the clamping frame the facing plate entirely covers the aperture, sealing it off tightly. On the one hand, a satisfactory sealing-tightness is achieved. The facing plates are at the same time guide elements since upon movement of the clamping frame, particularly during displacement of the clamping frame along a generatrix of the wall portion, the facing plates slide along the back of the wall portion, not only guiding the clamping frame in relation to the wall portion while so doing, but still guaranteeing the thrust pressure at the back of the wall portion which helps to contribute to the rigidity of the wall portion. Also advantageous is the fact that when exchanging the facing plates, which are adapted to the particular shape of the elements to be concreted in, particularly the climbing elements, one and the same core segment can be used for clamping variously formed elements which can be concreted in at the same time as the concrete part is manufactured. For adaptation purposes, all that is necessary is to exchange the facing plates, with no need to exchange the entire core segment for a completely different core segment.

In further advantageous embodiments a horizontal web is fixed to the back of the facing plates. In consequence, the clamping frame is additionally strengthened and made more rigid, which further contributes to greater strength. Not only the facing plate but also the horizontal web and rear web as well as well as the cross struts of the clamping frame contribute to the increase in flexural rigidity. Formed between the individual cross struts are very large window-like recesses in the clamping frame which permit of easy access, e.g., to the back of the wall portion. Furthermore, cleaning is facilitated. Any concrete which has penetrated can run out. Also advantageous is the fact that the entire clamping frame can be quickly and easily exchanged for another. By virtue of the separable fixing of the facing plates on the cross-struts, it is also possible quickly and easily to exchange the facing plates separately for other facing plates. Also, this means that for each individual facing plate, the clearance between it and the back of the wall portion can be adjusted without problem.

In a further advantageous embodiment each reinforcing rib has a supporting face, and the horizontal web has a surface which faces the supporting face. A plurality of elastic elements are located on the surface of the horizontal web which face the supporting face, the elastic elements being positioned in the region of the projecting elements, which are to be clamped in place there. In this way, the horizontal webs which carry the facing plates form therewith a transverse stiffening for the clamping frame and are at the same time utilized for the application of pressure.

If stirrups are to be concreted in as climbing elements simultaneously during manufacture of the moulded concrete part, then another embodiment is advantageous. In this embodiment the horizontal web has an upper face, the elastic elements are disposed on the upper face, and the clamping frame is adapted for movement into the closed and clamped position in which a bottom of an inserted projecting element can be pressed upwardly against the reinforcing web by the horizontal web with the facing plate. It ensures that the stirrups are first placed on the narrow face of the facing plates and the resilient elements, rigid clamping being achieved subsequently by raising the clamping frame so that the stirrups are pressed from below against the support face of the relevant reinforcing rib.

If, instead of this, other climbing elements, e.g., the climbing irons known in West Germany, Great Britain and Austria, have to be concreted into position, an additional embodiment is advantageous. In this embodiment the horizontal web has a bottom face, the elastic elements are disposed on the bottom face, and the clamping frame is adapted for movement downwardly into the closed and clamped position in which an inserted projecting element can be pressed downwardly against the reinforcing rib by the horizontal web and the facing plate. These elements are placed on the reinforcing ribs and are clamped from the top downward by means of the facing plates of the clamping frame.

In both cases, the features according a further embodiment are advantageous, each facing plate has a narrow face which is directed toward the reinforcing rib and is formed to correspond with the contours of the projecting element which is to be clamped, thus ensuring that even when the climbing element passes through the aperture in the wall portion, the tightest possible seal is guaranteed to prevent penetration of concrete, mortar or the like. Also advantageous in this connection is the design according to yet another embodiment. In this embodiment the projecting elements each have two arms, and the facing plate defines two substantially U-shaped, upwardly open recesses in the region of the narrow face, each U-shaped recess accommodatable to an arm of the inserted projecting element. If stirrups of different dimensions have to be concreted in, then the facing plates can be easily and quickly exchanged for the appropriate type.

In further advantageous embodiments the clamping frame has two lateral edges and defines a plane, and inner vertical struts are located on both lateral edges, directed transversely to the facing plates and substantially forming a T-shaped profile at a right angle to the plane of the clamping frame, or the clamping frame has two vertical sides; and vertical guide flanges marginally disposed on the vertical sides of the clamping frame and engaging the guide means on both vertical sides. These measures lead to a further strengthening of the clamping frame with the smallest possible use of materials and the least possible weight. At the same time, guide faces are provided on the clamping frame which serve for accurate, as far as possible clearance free guidance of the clamping frame on the wall portion.

In yet further advantageous embodiments the guide means includes lateral guide means mounted on the wall portion to guide the clamping frame for vertical movement parallel with the plane of the wall portion. The guide means can also be adjustably mounted on the side faces of the wall portion and biased in the direction of the clamping frame. Such guidance guarantees that the clamping frame is pressed against the back of the wall portion so that the facing plates always bear tightly against the back of the wall portion and thus ensure a satisfactory weal. By reason of the adjustability of the guides, the clearance between facing plates and back of the wall portion can be adjusted as required and can also be readjusted following wear or such like. Since in the clamped condition during the riddling and compaction process, the full clamping force is exerted by the clamping frame onto the clamped climbing elements, there is at the same time a clamping of the clamping frame against the wall portion. Therefore, the clamping frame performs no movements of itself. Instead, the wall portion on the one hand and the clamping frame on the other form altogether one unit, the core segment, which during the riddling process vibrates together with the rest of the mould core. The guides are therefore at least substantially relieved of these vibrations and are therefore subject to virtually no or only very minimal wear and tear. In this way, the wall portion on the one hand and the clamping frame on the other are vibration-proof, even in the long term. If the clamping frame has to be exchanged, all that is necessary is to dismantle the back guide means and the clamping drive. Then the clamping frame can be quickly and easily removed completely and exchanged for another.

A further advantageous embodiment has a plurality of articulating levers mounted to the wall portion and pivotally supporting and guiding the clamping frame for movement along an upwardly and at the same time inwardly directed arcuate path, so that only upon reaching a dead center position of the articulating levers are the facing plates pressed against the inside face of the wall portion. This embodiment has the advantage that the articulating levers which form links, can be equipped with maintenance-free ball joints. The clamping frame which in this case is preferably moved along a circular path, has its facing plates only pressed against the back of the wall portion via the articulating levers when these pivot into their dead center position in which the force emanating from the clamping drive can either be dispensed with entirely or at least reduced, since now the articulating levers in the dead center position are themselves capable of applying the thrust forces and also of transmitting very high vibratory forces. Thus it is possible to use the clamping drive only for movement between clamping position and release position and for the rest to disengage it without the clamping drive having to apply the abutment force in the clamping position.

In further advantageous embodiments the reinforcing rib defines a plane, and each aperture contained in the wall portion for supporting a respective projecting element is dimensioned to be wider, at least within the plane of the reinforcing rib, than the respective projecting element which is to be cemented in. In particular, where climbing irons have to be concreted into position and have their axis of symmetry aligned radially of the mould core, It is guarangeed that during the concreting-in, particularly after it has taken place, the climbing irons cannot be torn out again by the core segment. The measures allow for the fact that during movement between release position and shaping position, the core segment is moved substantially at a right-angle to a diametral plane and that the direction of movement does not coincide with the axis of symmetry of the climbing iron.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
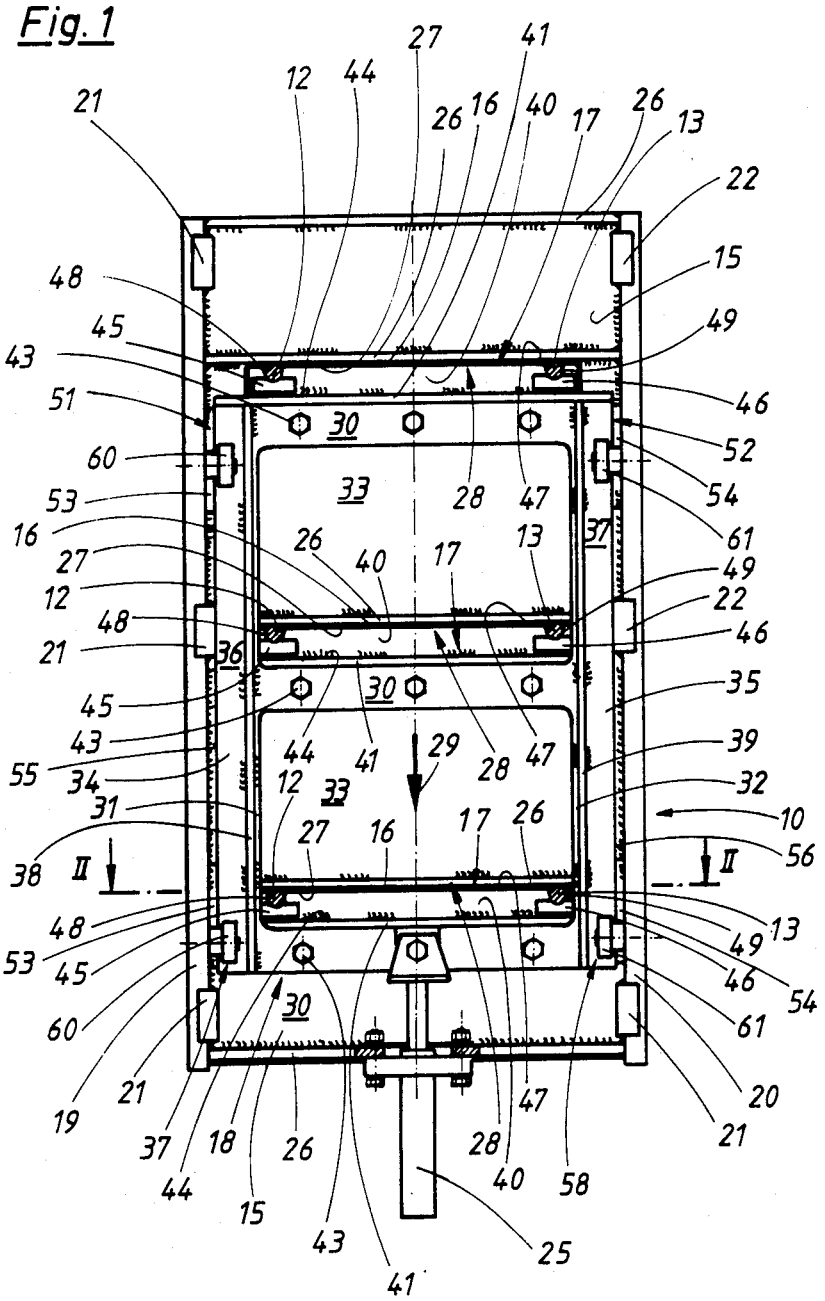
FIG. 1 is a diagrammatic side view of a core segment of a moulding apparatus for the forming of concrete parts according to a first embodiment, viewed from the interior and in the closed position.
Figure 2:
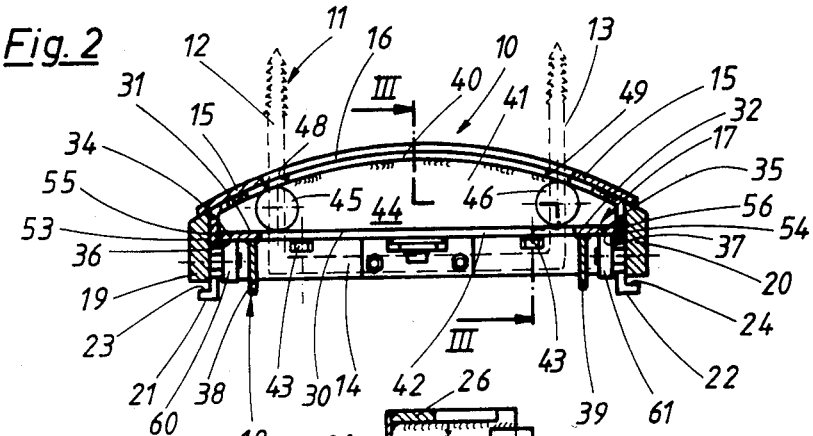
FIG. 2 is a diagrammatic section taken on the line II—II in FIG. 1.
Figure 3:
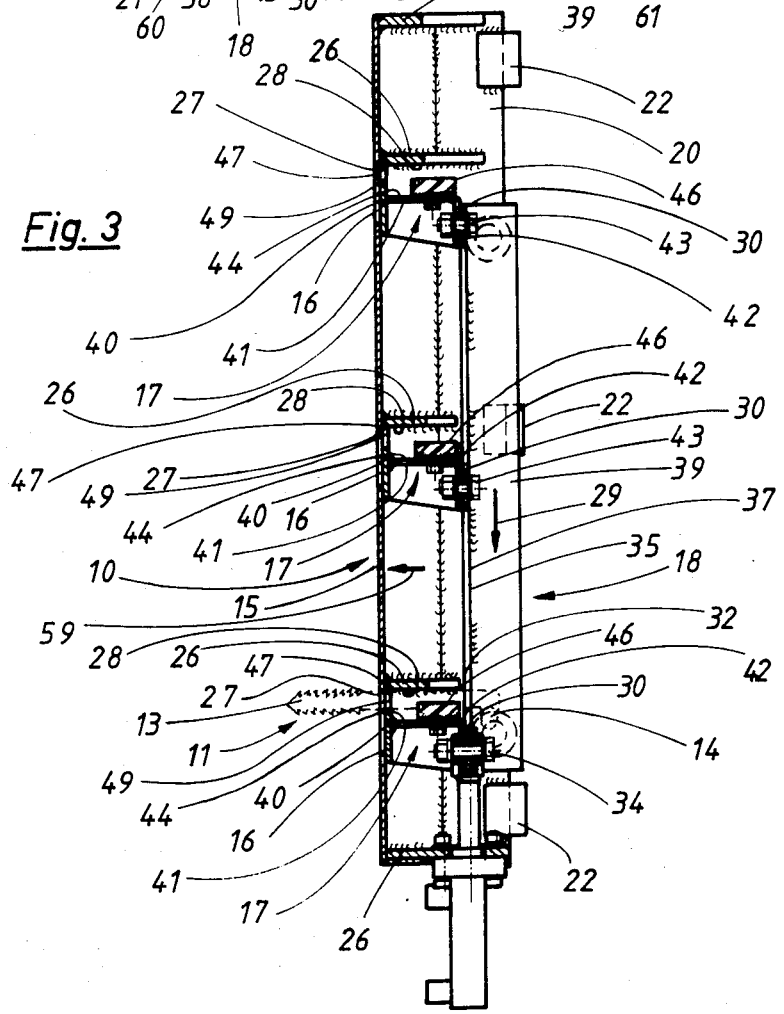
FIG. 3 is a diagrammatic section taken on the line III—III in FIG. 2.

FIGS. 1 to 3 show a preferably exchangeable core segment 10 which is part of a mould core of a moulding apparatus, not shown in greater detail but which is used for the forming of concrete parts, particularly shaft rings, shaft necks, well linings, transition rings or the like. Details of such a moulding apparatus are to be found for instance in German Utility Model No. 84 03 621. The same applies to the mode of operation and the procedure used in forming.

The mould core is so constructed that during shaping of the concrete part, it is possible, perferably simultaneously, to concrete into it from within a plurality of projecting elements of any desired kind, in particular climbing elements, in the case of the first embodiment stirrups 11. The stirrups 11 are substantially U-shaped. They have two arms 12, 13 and a downwardly cranked tread 14. The core segment 10 according to the first embodiment is so designed that a plurality of stirrups 11 can be concreted in one below another along an area of a cylindrical shell, in other words without any transverse stagger.

The core segment 10 has a wall portion 15 which can at the top end also be provided with a cover portion. The wall portion 15 takes the form of a portion of the cylinder wall of the mould core, not shown in greater detail. For each climbing element which is to be concreted into place, particularly for each stirrup 11, the wall portion 15 has an associated aperture 16 with a housing for correctly positioned accommodation of a stirrup 11 which, prior to the moulding process, requires to be introduced from outside through the aperture 16 in order to be concreted into position. Each aperture 16 has substantially the shape of a rectangular window and extends transversely of the cylinder generatrix. A clamping device 17 is associated with each aperture 16 with a housing. The individual housings and clamping devices 17 are disposed on a common clamping frame 18 which extends on the inside of the wall portion 15.

The wall portion 15 carries on both vertical edges welded-on rails 19, 20 which serve to strengthen it. Welded onto each rail 19, 20 are angles 21, 22 disposed at intervals in a vertical direction and which, together with the facing surface of the relevant rail 19, 20, form a guide slot 23, 24. Upon vertical insertion of the core segment 10 into an accurately fitting cutout in the shell of the mould core, guide strips which permit of perpendicular insertion and oppositely directed withdrawal, engage into the guide slot 23, 24. These guide strips, not shown in greater detail, are for the rest coupled to a drive means located in the mould core and via which these guide strips can be moved to operate displacement of the core segment in the horizontal direction of the mould core (German Utility Model No. 84 03 621). The clamping frame 18 is engaged by, common to all clamping devices 17, a clamping drive 25 which here consists of a hydraulic or pneumatic working cylinder.

On its inside face, the wall portion 15 has fixed reinforcing ribs 26 which extend transversely to the plane of the wall portion 15 and inwardly therefrom, so that a substantially T-shaped cross-section results (FIG. 3). Such reinforcing ribs 26 are provided not only in the region of the relevant aperture 16 but also at the upper and lower ends of the wall portion 16. The reinforcing ribs 26 extend over the full width of the wall portion 15. They extend as far as the lateral rails 19 and 20. The reinforcing ribs 26 are constructed as annular strips, particularly annular plates, which are welded to the inside face of the wall portion 15. The reinforcing ribs 26 disposed in the region of the apertures 16 are directly adjacent to the top edge 27 of the apertures 16. On their underside which is at the bottom of FIGS. 1 and 3 they have in each case a flat supporting face 28 for receiving and supporting the relevant climbing element, particularly stirrup 11.

Formed in the manner described, the wall portion 15 consists in this form of a one-piece welded structure, the rails 19, 20 simultaneously serving a strengthening function. Above all the reinforcing ribs rigidify the wall portion 15, serving at the same time the dual function of supporting the stirrups 11. In this way, the wall portion 15 is extremely stable and resistant to flexion.

The clamping frame 18 is disposed on the inside of the wall portion 15 and thus between the rails 19, 20 is, by means of special guide means on the wall portion 15, upon actuation of the clamping drive 25, movable downwardly and upwardly in a direction parallel with the wall portion 15 between the release position, drawn downwardly in the direction of the arrow 29, and the closed position, riased in FIGS. 1 to 3.

The clamping frame 18 has individual cross-struts 30 which extend approximately to the height of the individual clamping devices 17, merging at both ends into lateral frame arms 31, 32. Large area window cut-outs 33 are formed between the frame arms 31, 32 and the cross struts 30 extending transversely thereto and these cut-outs 33 afford ready access to the inner areas of the core segment 10, for example for cleaning purposes and for allowing any penetrating cement to run away. The clamping drive 25 in the example shown engages the lower cross-strut 30 but in another embodiment, not shown, it can also engage any desired part of the clamping frame 18 either laterally or at the upper end. The lateral frame arms 31, 32 merge at the edges into vertically extending guide arms 34, 35, each of which carries on the back a guide face 36, 37 for guide means as yet to be explained. On the back of the frame arms 31, 32 with guide arms 34, 35, there extend from the top downwardly continuous vertical struts 38, 39 which are welded thereon and which are directed substantially at a right-angle to the guide face 36, 37, forming a T-shaped cross-section. In this form, the clamping frame 18 constitutes a one-piece welded structure possessing extremely high flexural resistance while at the same time being relatively lightweight and space-saving due to provision of the large window cut-outs 33, to the extent that the reinforcing ribs 26 on the wall portion 15 can run over the total transverse extent thereof as far as the rails 19, 20 on either side.

The clamping frame 18 has for each aperture 16 with a housing and provided in the wall section 15 a metal facing plate 40 disposed on the inside of the wall portion 15 and bearing directly on the back thereof. The facing plate 40 takes the form of the wall portion 15, at least in the region of the relevant aperture 16. With regard to its surface area, each facing plate 40 is sufficiently large that in the closed position of the clamping frame 18 (FIGS. 1 to 3), it covers the associated aperture 16 entirely, doing so with areliably tight seal. At the same time, the facing plate 40, at least in the closed position of the clamping frame 18, is pressed at the back against the wall portion 15 being furthermore held thereon and adapted for movement along this back surface during movement downwardly according to arrow 29 into the release position and back upwardly into the closed position. Each facing plate 40, therefore, serves at the same time as a guide means for guiding the clamping frame 18 along the wall portion 15.

The individual facing plates 40 are separably and exchangeably held on the clamping frame 18, being in particular welded thereto. To this end, the individual facing plates 40 are at the back in each case fixed, in particular welded, on a horizontal web 41 which, together with the facing plate 40, forms a substantially T-shaped cross-section of extraordinarily high flexural strength. At a distance from the facing plate 40, the horizontal web 41 has, fixed thereon and, for example, integral therewith, a back web 42 which bears on the front face of the relevant cross-strut 30 to which it is separably fixed by screws 43. The horizontal web 41 which serves for separable fitment of the facing plate 40 on the cross-strut 30 of the clamping frame 18, is at the same time designed to be part of the clamping device 17. On the side which is toward the supporting face 28 of the reinforcing rib 26, in other words in the case of the first embodiment on the upper side 44, it has in the region of the rising elements which are to be clamped thereto, in this case the arms 12 and 13 of each stirrup 11, elastic elements 45, 46 which in this case are constructed for example as bolted-on rubber buffers. With this construction, for clamping the stirrups 11, the clamping frame 18 is adapted for movement in the opposite direction to the arrow 29 (FIG. 3) from the bottom upwardly into its closed and clamping position, in which the inserted sitrrups 11 are pressed in the region of their arms 12, 13 by the elastic elements 45, 46 from the underneath against the supporting underside 28 of the relevant reinforcing rib 26.

On its narrow face 47, which is directed toward the supporting underface 28 of the relevant reinforcing rib 26, each facing plate 40 is shaped according to the contours of the elements to be clamped, in this case the contours of a stirrup 11. The narrow face 47 is therefore exactly matched to the contours of the particular climbing element involved, in fact so that virtually no intermediate spaces are provided through which any concrete might penetrate. In the case of the first example, adaptation to the contours of the stirrups 11 makes it look as if the narrow face 47 of each facing plate 40 for each arm 12, 13 has a substantially U-shaped open-topped recess 48, 49 in which the appropriate arm 12, 13 of an inserted stirrup 11 is housed. The stirrup 11 is inserted in this way, its arms 12, 13 at the same time resting on the elastic elements 45, 46. The closure movement of the clamping frame 18 then takes place in an upwards direction by displacement in a sense opposite to that of the arrow 29.

For lateral guidance during the displacement movement in the direction of the arrow 29 and in the opposite direction, in other words to secure the displacement movement parallel with a generatrix of the wall portion 15, there are held on both rails 19, 20 of the wall portion 15 lateral guide means 51, 52 which laterally engage the two guide arms 34, 35. The lateral guide means 51, 52 are here constructed as sliding guides. They consist for example of two sliding members 53, 54 located above each other at intervals on either side and co-operating with the narrow face 55, 56 of the guide arm 34, 35 acting as a guide surface. It will be appreciated that instead of the sliding guide means 51, 52, a different embodiment, not shown, may also employ roller guides, e.g. guide rollers. Also the angles 21, 22 provided over the length between the bilateral sliding members 53, 54 may have the surface which is toward the narrow face 55, 56 called upon to act as a lateral sliding guide.

Furthermore, there are held on the lateral rails 19, 20 of the wall portion 15 back guide means 57, 58 which engage the back of the clamping frame 18. The back guide means 57, 58 lie on the back guide face 36, 37 of the guide arms 34, 35 and exert a guide pressure in the direction of the wall portion 15, i.e. in the direction of the arrow 59 (FIG. 3) and forwards. The effect of this guide pressure is that the individual facing plates 40, at least in the illustrated closed position of the clamping frame 18, are pressed against the back of the wall portion 15 and tightly seal the individual apertures 16. The back guide means 57, 58 are constructed as roller guides. They consist of two guide rollers 60, 61 on each side, rolling on the back guide face 36, 37. The guide rollers 60, 61 are adjustable to compensate for guide clearance. This is guaranteed, for instance, by the fact that the guide rollers 60, 61 are supported on per se known adjustable eccentric arbors, not shown in greater detail.

The construction of clamping frame 18 described and having facing plates 40 pressed against the back of the wall portion 15 in the region of the apertures 16 makes it possible for the apertures 16 to be very large. In this way, the climbing elements, in this case the stirrups 11, can be inserted without problem. Also form removal after shaping of the concrete part with the concrete-in stirrups 11 is problem-free. By virtue of the highly flexural resistant welded structure, reinforced by the elements described, on the onehand of the wall portion 15 and on the other of the clamping frame 18, it is guaranteed that the core segment 10 will over the long term withstand the oscillations obtaining during vibration and will exhibit a long effective life without suffering damage. The design of the individual clamping devices 17 of the type described guarantees a rigid vibration-proof clamping of the inserted climbing elements, in this case stirrups 11. By means of the back guide means 56, 58 in the form of guide rollers 60, 61, the clamping frame 18 is pressed in the direction of the arrow 59 against the back of the wall portion 17 and is held in this form, although it is upwardly and downwardly movable. At the same time, the facing plates 40 are pressed rigidly and tightly against the back of the wall portion 15 in the region of the relevant aperture 16. Thus, guidance and support for the clamping frame 18 on the wall portion 15 are provided in this area as well. In the case of a core segment 10 inserted into a moulding core, the full force of the drive device during the vibrating and compaction process of the concrete constantly acts on the core segment 10, the entire core segment 10 being rigidly clamped into one unit by the high hydraulic pressure applied, so that the clamping frame 18 cannot perform any movements of its own, but vibrates as a unit together with the wall portion 15. During the vibrating and compaction operation, therefore, the core segment 10 forms a unit which is rigidly clamped to the rest of the moulding core. In particular the back guide means 57, 58 and the guide faces 36, 37 are relieved, so guaranteeing minimum possible wear in the region of the guides. Furthermore, it is ensured that vibrations generated via a central vibrator on which the mould core is mounted are transmitted not only to the mould core but, as a unit rigidly connected thereto, simultaneously also to the core segment 10 and the clamped-in stirrups 11. By reason of the adjustability at least of the back guide means 57, 58, it is possible at any time to adjust the guide clearance and the play in the individual facing plates 40 accurately to the desired degree. By virtue of the fact that the individual facing plates 40 are separably mounted on the clamping frame 18, for example by means of screws 43, the clamping frame is at the same time transversely strengthened. Also, the individual facing plates 40 can be exchanged quickly and without problem. For the rest, the screwed connection means that the clearance between the individual facing plates 40 and the wall portion 15 can also be individually adjusted. The special advantage of the core segment 10 resides in the fact that all possible kinds of projecting elements, particularly climbing elements, can be concreted into concrete parts directly during the shaping process. Both the clamping frame 18 and the wall portion 15 and also the entire core segment 10 become to a high degree vibration-proof, flexurally rigid and of stable form. Guidance is adjustable so that the clearance between the facing plate 40 and the wall portion 15 can be adjusted quickly and without problem. The guidance arrangement is so designed that the facing plates 40 are only pressed against the back of the wall portion 15. Another advantage is that the entire clamping frame 18 with the individual facing plates 40 can easily and quickly be dismantled from the rest of the core segment 10 and exchanged for another. To do so, it is necessary only to disconnect the clamping drive 25 and to unscrew the back guidance means 57, 58.

Figure 4:
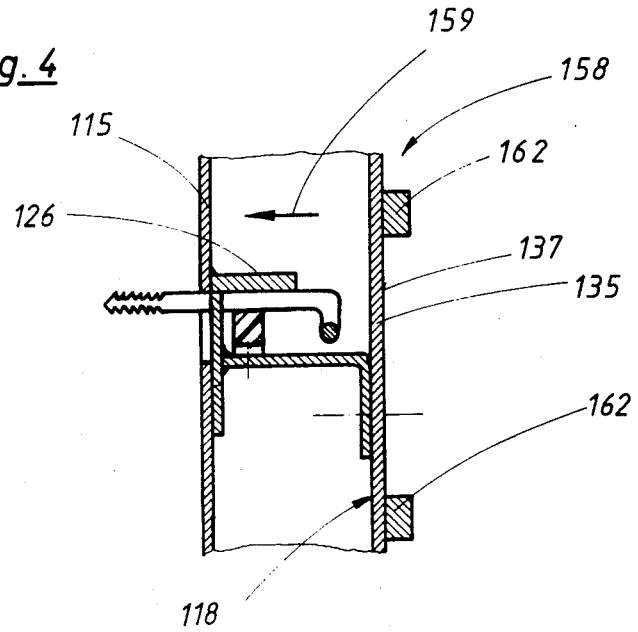
FIG. 4 is a diagrammatic section substantially corresponding to that in FIG. 3 of a part of a core segment according to a second embodiment, in the closed position.

In the case of the second embodiment shown in FIG. 4, for parts which correspond to the first embodiment, reference numerals are used which are raised by 100, so that, to avoid repetitions, reference is made to the description of the first embodiment.

The second embodiment in FIG. 4 differs from the first only in that the back guide means 158 are designed not as roller guides but as sliding guides and have sliding members 162 which rest on the back guide face 137 of the guide arm 135 of the clamping frame 118, so producing guidance with an application of pressure in the direction of the arrow 159 against the wall portion 115. Also these sliding members 162 are adjustable.

Figure 5:
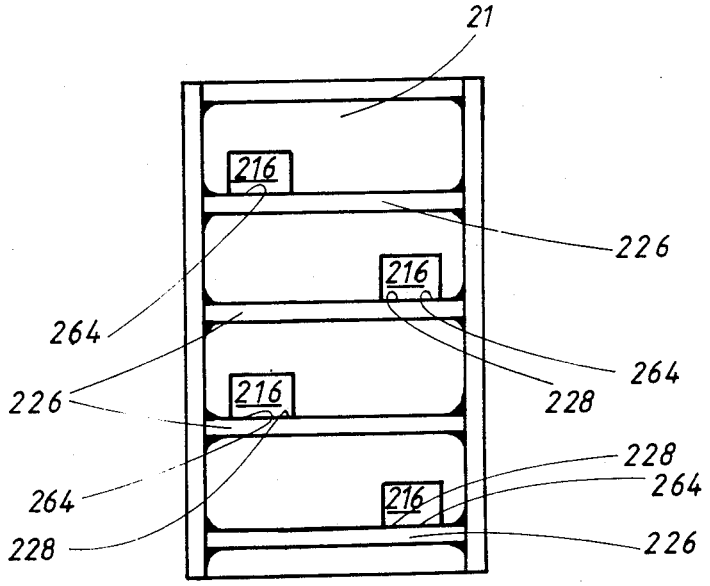
FIG. 5 is a diagrammatic side view of the wall portion of a core segment according to a third embodiment, viewed from inside.
Figure 6:
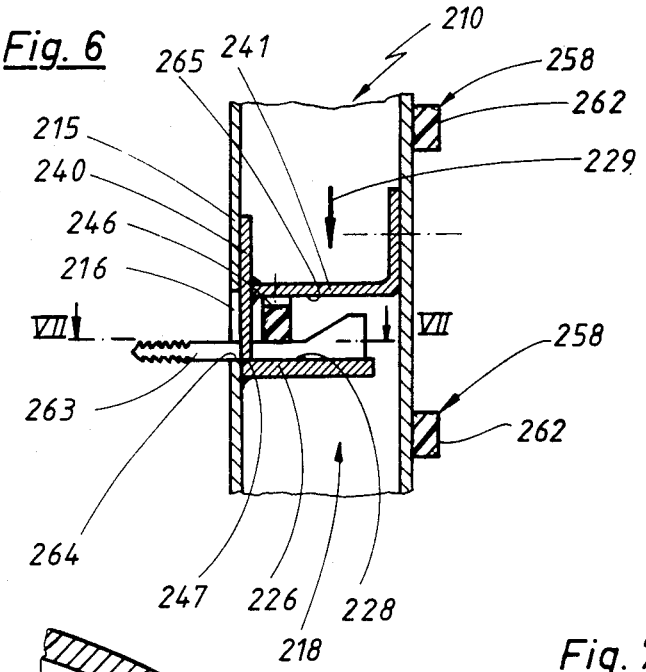
FIG. 6 is a diagrammatic section substantially corresponding to that in FIG. 4 of part of a core segment according to the third embodiment, in the closed position.
Figure 7:
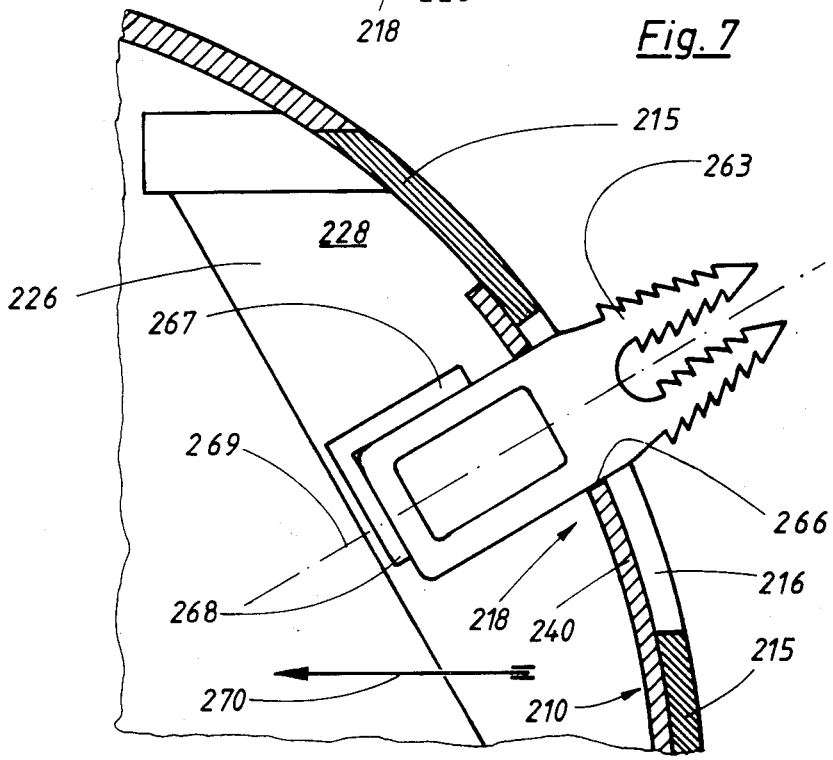
FIG. 7 is a diagrammatic horizontal section taken on the line VII—VII in FIG. 6, on a larger scale.

In the case of the third embodiment according to FIGS. 5 to 7, the core segment 210 is arranged for direct vibration of staggered climbing irons 263, such as are conventional, for instance, in the German Federal Republic, in England and in Austria. Here, the apertures 216 provided in the wall portion 215 are staggered in the transverse direction of the wall portion 215. In a corresponding relationship, the individual facing plates 240 provided for each aperture 216 are correspondingly staggered on the clamping frame 218. In contrast to the first and second embodiments, the reinforcing ribs 226, by reason of the use of climbing irons 263, are here disposed at the level of the bottom edge 264 of the relevant aperture 216. The reinforcing ribs 226 are in this case provided on their top side which points upwards in FIG. 6, at the same time with a flat supporting face 228 in the region of the aperture 216 to receive the climbing iron 263, the underside of which is flat. Furthermore, the elastic elements 246, in contrast to the first and second embodiments, are here disposed on the underside 265 of the horizontal web 241 which is directed toward the supporting face 228. In contrast to the first embodiment, the clamping frame 218 is adapted for movement in the direction of the arrow 229, downwardly into the closed and clamping position shown in FIG. 6 in which the climbing iron 263, which rests on the supporting face 228 of the reinforcing ribs 226, can be pressed by the elastic elements 246 of the horizontal web 241 and the facing plate 240 downwardly and against the reinforcing rib 226. That narrow face 247 of the facing plate 240 which is directed downwardly in FIG. 6 is, where it projects upwardly beyond the supporting face, exactly adapted to the contours of the climbing iron 263, so that in the position shown in FIG. 6, when the facing plate 240 is brought into the closed position, that part of the climbing iron 263 which it covers is taken in. In FIG. 7, this is represented as an open-bottomed cut-out 266 in the narrow face 247 of the facing plate 240, the width of this cut-out 266 corresponding to the width of the climbing iron 263 in this area, the depth of the cut-out 266 being of eactly the same dimensions as the height of the climbing iron 263 at this point. As with the second embodiment, so here, too, the clamping frame 217 is guided by sliding members 262. FIG. 7 shows that each reinforcing rib 226 has on its upper supporting face 228 upwardly projecting centering parts 267, 268. In this case, these are adapted to the particular feature whereby the climbing iron 263 has its axis of symmetry 269 directed radially toward the middle of the mould core, not shown in greater detail. The displacement movement of the core segment 210 into the not shown release position for form removal does not on the other hand take place in a radial direction but in a direction at a right-antle to a diametral plane according to arrow 270. If, otherwise than is shown in FIG. 7, the centering parts 267, 268 were to be placed farther down, then upon displacement of the core segment 210 in the direction of the arrow 270, at least one centering part would remain attached to the concreted-in climbing iron 263 and would tear this out with it. This is however prevented by the location of the centering parts 267, 268. These are orientated substantially at an angle to each other, one centering part 268 representing a back centering part while the other centering part 267 performs its centering function by resting against what in FIG. 7 is the upper lateral zone of the climbing iron 263. For the reasons mentioned, furthermore, the aperture 216 which happens to be embodied in the wall portion 215 is, at least within the plane of the relevant reinforcing ribs 226, of wider dimensions than the climbing iron 263 which is to be concreted into position. This greater width of opening in the aperture 216 is particularly noticeable in FIG. 7 below the climbing iron 263.

For concreting-in the climbing iron 263, this is so placed on the support face 228 of the reinforcing ribs 226 while the core segment 210 is run forwards into the release position, for instance in the direction of the arrow 270, that the centered position according to FIG. 7 is assumed. Even at this point in time, the clamping frame 218 can be moved downwards into the clamping position in the direction of the arrow 229, the clamping iron 263 being received exactly within the cut-out 227 in the facing plate 240 and being pressed downwardly onto the supporting face 228 by the narrow face 247 thereof. Furthermore, the elastic elements 246 on the horizontal web 241 press downwardly onto the climbing iron 263 which is thus rigidly clamped in the core segment 210. For concreting-in, then, the core segment 210 can be run forwards into the shaping position in the opposite direction to the arrow 270. During this movement, the wide aperture 216 in the wall portion 215 allows passage of the climbing iron 263 with its projecting end which is to be cemented into the concrete. After the shaping process, for form removal, firstly the clamping frame 218 is pushed upwards in the opposite direction to the arrow 229, in fact sufficiently far that the narrow face 247 of the facing plates 240 extends at a distance above the greatest promontory of the climbing iron 263 which is thus no longer clamped. In this condition, the core segment 210 can be moved in the direction of the arrow 270 by horizontal displacement into its release position. As this happends, the lower support face 228 of the reinforcing rib 226 with the centering parts 267, 268 as a unit will move in the direction of the arrow 267 away from the climbing iron 263 without any parts remaining attached to the cemented-in climbing iron 263.

Figure 8:
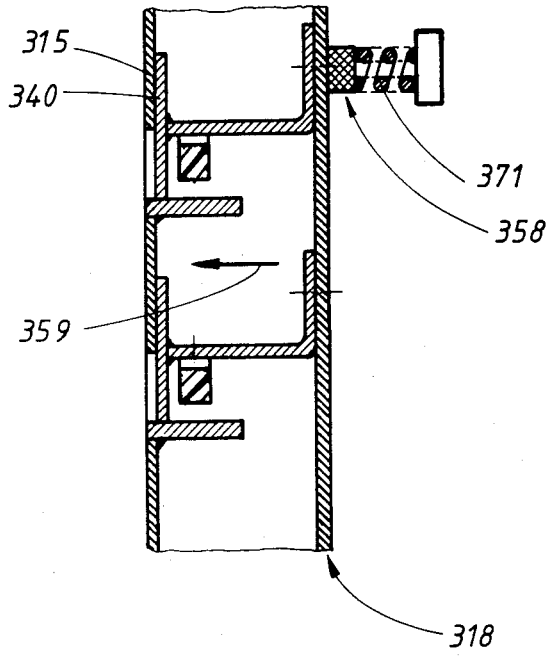
FIGS. 8, 9 and 10 show in each case a diagrammatic section of part of a core segment according to a fourth, fifth and sixth embodiment, respectively, in each case in the closed position.

In the case of the fourth embodiment shown in FIG. 8, at least the back guide means 358 are initially tensioned in the direction of the arrow 359 to the clamping frame 318 in resilient fashion by a cylindrical coil spring 371. Thus, the back guide means 358 are automatically adjustable. The facing plates 340 are therefore pressed at a constant and clearly defined force in the direction of the arrow 358 against the back of the wall portion 315. Even during the relative sliding movement during displacement of the clamping frame 318 in a vertical direction upwardly or downwardly, an evenly applied pressure results. This has the advantage that in the event of wear and tear occurring on the back guide of the clamping frame 318 or the facing plates 340, there is an automatic readjustment by the coil spring 371, so that the facing plates 340 always work without clearance. Furthermore, the coil springs 371 permit a resilient yielding of the clamping frame 318, e.g. in the event of any dirt in the facing plates 340 and the wall portion 315. This resilient behaviour overcomes the risk of the guides jamming and always guarantees an equal degree of applied pressure.

Figure 9:
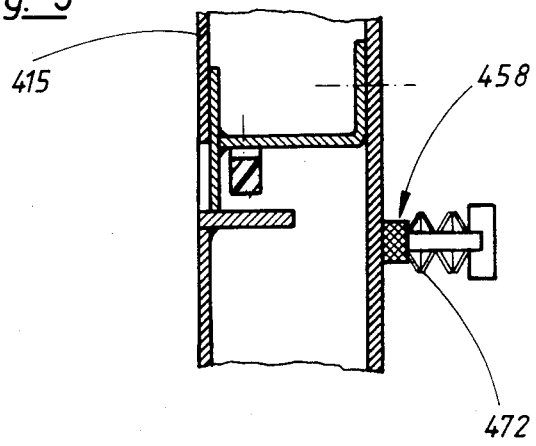

In the case of the fifth embodiment in FIG. 9, which otherwise corresponds to that shown in FIG. 8, the resilient pretensioning of the back guide means 458 is achieved by plate springs 472.

Figure 10:
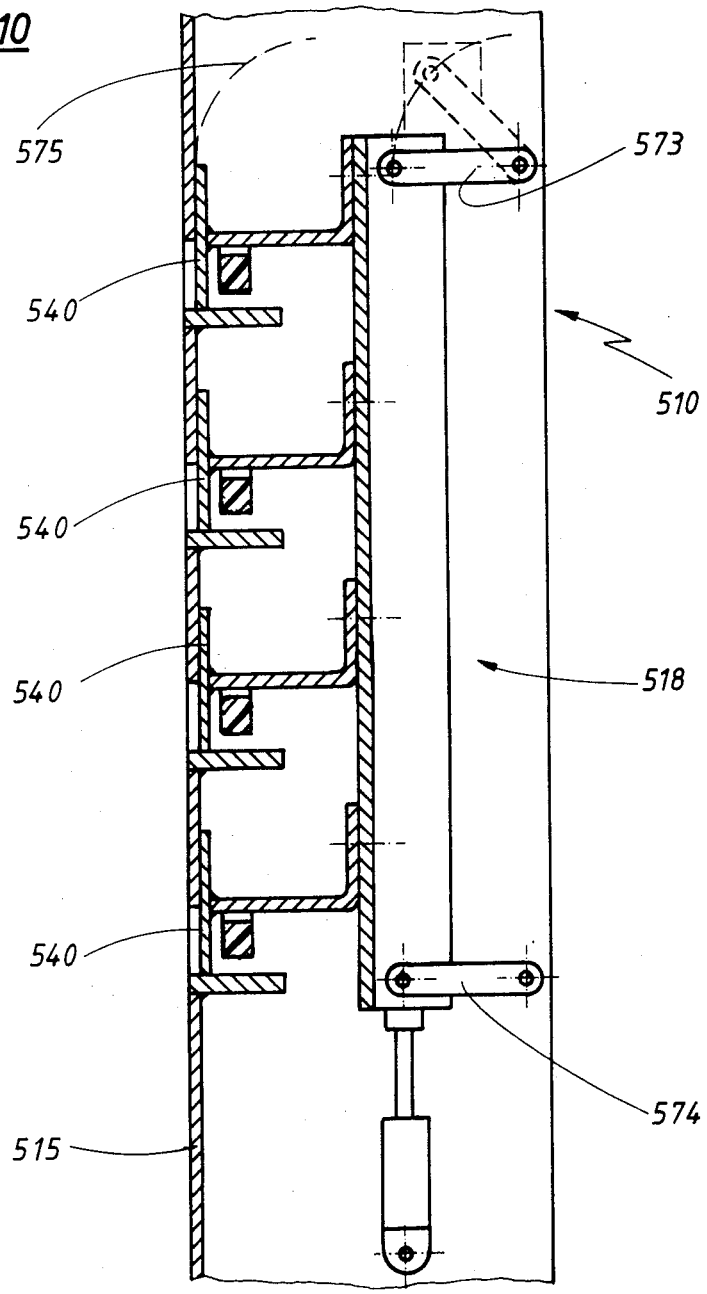

In the case of the sixth embodiment in FIG. 10, the clamping frame 518 is pivotally mounted and guided on the wall portion 515 by means of an arrangement of articulating levers 573, 574 so that the clamping frame 518 is pivotally movable along an upwardly and at the same time inwardly and possible oppositely thereto orientated curved path 575, which constitutes a circular path, so that the individual facing plates 540 are pressed from the inside against the wall portion 515 only after they have reached a preferably extended dead center position of the articulating levers 73, 574. The articulating levers 573, 574 constitute links which can in per se known manner be equipped with maintenance free ball joints. This construction of the core segment 510 ensures that the facing plates 540 are only pressed against the back of the wall portion 515 when the articulating levers 573, 574 have pivoted into their dead center position. Such articulating levers 573, 574 can also transmit very high vibratory forces.

While the invention has been illustrated and described as embodied in a core segment for forming equipment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A core segment for molding equipment used in forming concrete parts which are provided with at least one projecting element, particularly a climbing element, such as a climbing iron, stirrup or the like, which during a forming process is cemented from the inside into the concrete parts which are to be formed, the core segment comprising:

a wall portion having an inside face, a plurality of apertures having upper and lower edges and housings for supporting the projecting elements;

clamping means associated with said housings for clamping projecting elements;

a clamping drive associated with and engaging said clamping means;

reinforcing ribs provided on said inside face of said wall portion and extending inwardly from and transversely to said wall portion, said clamping means including associated clamping devices and a common clamping frame located on said wall portion, said housings for the projecting elements and said associated clamping devices being located on said common clamping frame, said clamping means further including guide means for said clamping frame so that, upon actuation of said clamping drive, said clamping frame being guided for movement between a release position and a closed position in a direction parallel with sald wall portion, said wall portion having a shape, and said clamping means further including facing plates, one of said facing plates being provided for each of said aperture, disposed on said inside face of said wall portion and having a shape corresponding to the shape of said wall portion at least in the region of a respective aperture, each said facing plate having a surface area sufficiently large so that in said closed position of said clamping frame said facing plate entirely covers said aperture, sealing it off tightly, said facing plates each having a back, and a horizontal web to which said facing plates are fixed at said back, said clamping frame having a cross-strut and said horizontal web having a rear web fixed to said cross-strut at a distance from said facing plate.

2. A core segment as defined in claim 1, wherein said wall portion has a predetermined width, and said reinforcing ribs extend completely over said width of said wall portion.

3. A core segment as defined in claim 1, wherein said reinforcing ribs are constructed as annular strips formed to extend at a right angle from said wall portion.

4. A core segment as defined in claim 3, wherein said annular strips are welded onto said wall portion.

5. A core segment as defined in claim 1, wherein said reinforcing ribs are directly adjacent to said lower edge of said apertures, and have an upper face extending substantially at a right angle to said wall portion, said upper face forming a flat supporting face for a projecting element.

6. A core segment as defined in claim 1, wherein said wall portion has two side edges; and further comprising rails and guides located on both said side edges and extending transversely of said reinforcing ribs, said rails and guides being provided for core segment exchange.

7. A core segment as defined in claim 1, wherein said clamping frame can be guided along an upwardly and, at the same time, inwardly curved path to said release position and can also be guided outwardly and downwardly, opposite to said upwardly and inwardly curved path.

8. A core segment as defined in claim 1, wherein said facing plate presses against and is guided on said wall portion at least in said closed position of said clamping frame.

9. A core segment as defined in claim 1, wherein said facing plates are welded to said horizontal web.

10. A core segment as defined in claim 1, wherein said horizontal web fixed with said facing plate forms a substantially T-shaped cross-section.

11. A core segment as defined in claim 1, wherein said rear web is detachably fixed to said cross-strut.

12. A core segment as defined in claim 1, and further comprising a plurality of elastic elements located on said surface of said horizontal web which face said supporting face, said elastic elements being positioned in the region of the projecting elements, which are to be clamping in place there.

13. A core segment as defined in claim 12, wherein said elastic elements are rubber buffers.

14. A core segment as defined in claim 12, wherein said horizontal web has an upper face, said elastic elements are disposed on said upper face, and said clamping frame is adapted for movement into said closed and clamped position in which a bottom of an inserted projecting element can be pressed upwardly against said reinforcing web by said horizontal web with said facing plate.

15. A core segment as defined in claim 12, wherein said horizontal web has a bottom face, said elastic elements are disposed on said bottom face, and said clamping frame is adapted for movement downwardly into the closed and clamped position in which an inserted projecting element can be pressed downwardly against said reinforcing rib by said horizontal web and said facing plate.

16. A core segment as defined in claim 1, wherein each said facing plate has a narrow face which is directed toward said reinforcing rib and is formed to correspond with the contours of the projecting element which is to be clamped.

17. A core segment as defined in claim 16, wherein the projecting elements each have two arms, and said facing plate defines two substantially U-shaped, upwardly open recesses in the region of said narrow face, each said U-shaped recess accommodatable to an arm of the inserted projecting element.

18. A core segment as defined in claim 1, wherein said clamping frame has two lateral edges; and further comprising inner vertical struts located on both said lateral edges, directed transversely to said facing plates and substantially forming a T-shaped profile at a right angle to the clamping frame.

19. A core segment as defined in claim 1; and further comprising a plurality of articulating levers mounted to said wall portion and pivotally supporting and guiding said clamping frame for movement along an upwardly and, at the same time, inwardly directed arcuate path, so that only upon reaching a dead center position of said articulating levers are said facing plates pressed against said inside face of said wall portion.

20. A core segment as defined in claim 19, wherein said movement of said clamping frame is movable along a downwardly and outwardly directed arcuate path.

21. A core segment as defined in claim 19, wherein said articulating levers guide said clamping frame along an arcuate path.

22. A core segment as defined in claim 1, wherein each reinforcing rib defines a plane, and each said aperture contained in said wall portion for supporting a respective projecting element is dimensioned to be wider, at least relative to the plane of said reinforcing rib, than the respective projecting element which is to be cemented in.

23. A core segment for molding equipment used in forming concrete parts which are provided with at least one projecting element, particularly a climbing element, such as a climbing iron, stirrup or the like, which during a forming process is cemented from the inside into the concrete parts which are to be formed, the core segment comprising:

a wall portion having an inside face, a plurality of apertures having upper and lower edges and housings for supporting the projecting elements;

clamping means associated with said housings for clamping the projecting elements;

a clamping drive associated with and engaging said clamping means; and reinforcing ribs provided on said inside face of said wall portion and extending inwardly from and transversely to said wall portion, said clamping means including associated clamping devices and a common clamping frame located on said wall portion, said housings for the projecting elements and said associated clamping devices being located on said common clamping frame, said clamping means further including guide means for said clamping frame so that, upon actuation of said clamping drive, said clamping frame is guided for movement between a release position and a closed position in a direction parallel with said wall portion, said wall portion having a shape, and said clamping means further including at least one facing plate, one said facing plate being provided for each of said apertures, disposed on said inside face of said wall portion and having a shape corresponding to the shape of said wall portion at least in the region of a respective aperture, each said facing plate having a surface area sufficiently large so that in said closed position of said clamping frame said facing plate entirely covers said aperture, sealing it off tightly, said clamping frame has two vertical sides; and vertical guide flanges marginally disposed on said vertical sides of said clamping frame and engaging said guide means on both said vertical sides.

24. A core segment as defined in claim 23, wherein said guide means includes lateral guide means mounted on said wall portion to guide said clamping frame for vertical movement parallel with said plane of said wall portion.

25. A core segment as defined in claim 24, wherein said lateral guide means includes slide guides consisting of slide members.

26. A core segment as defined in claim 24, wherein said lateral guide means includes roller guides consisting of guide rollers.

27. A core segment as defined in claim 24, wherein said wall portion has side faces, and said lateral guide means are adjustably mounted on said side faces of said wall portion for adjustment of a given guide clearance.

28. A core segment as defined in claim 24, wherein said lateral guide means having biasing means for biasing said guide means in the direction of said clamping frame.

29. A core segment as defined in claim 24, wherein said lateral guide means having tensioning means for tensioning said guide menas in the direction of said clamping frame.

30. A core segment as defined in claim 23, wherein said clamping frame and said vertical guide flanges have a back side, and said guide means includes back guide means mounted on said wall portion that engage said back side of said clamping frame and bear on said back side of said guide flanges and exert a guiding pressure in the direction of said wall portion, so that in at least the closed position of said clamping frame said facing plates are pressed against said wall portion in such a way as to seal said apertures.

31. A core segment as defined in claim 30, wherein said back guide means includes slide guides consisting of slide members.

32. A core segment as defined in claim 30, wherein said back guide means includes roller guides consisting of guide rollers.

33. A core segment as defined in claim 30, wherein said wall portion has side faces, and said back guide means being adjustably mounted on said side faces of said wall portion for adjustment of a given guide clearance.

34. A core segment as defined in claim 30, wherein said back guide means having biasing means for biasing said guide means in the direction of said clamping frame.

35. A core segment as defined in claim 30, wherein said back guide means having tensioning means for tensioning said guide means in the direction of said clamping frame.

36. A core segment for molding equipment used in forming concrete parts which are provided with at least one projecting element, particularly a climbing element, such as a climbing iron, stirrup or the like, which during a forming process is cemented from the inside into the concrete parts which are to be formed, the core segment comprising:

a wall portion having an inside face, a plurality of apertures having upper and lower edges and housings for supporting the projecting elements;

clamping means associated with said housings for clamping the projecting elements;

a clamping drive associated with and engaging said clamping means;

reinforcing ribs provided on said inside face of said wall portion and extending inwardly from and transversely to said wall portion, said reinforcing ribs being directly adjacent to said upper edges of said apertures and having a lower face extending substantially at a right angle to said wall portion, said lower face forming a flat supporting face for a projecting element; and centering parts projecting from said supporting face of each said reinforcing rib, said centering parts being directed substantially at a right angle to each other forming an angles member having two arms, one arm of said angled member constituting means for centering a back of a projecting element which is to be cemented in, while the other arm of said angled member forms a lateral centering means, and upon movement of the core segment into a release position, both arms of said angled member move inwardly and away from the projecting element thereby releasing it.

* * * * *